US008663030B2

(12) United States Patent
Evans

(10) Patent No.: US 8,663,030 B2
(45) **Date of Patent: *Mar. 4, 2014**

(54) GOLF CLUB HEAD WITH ADJUSTABLE WEIGHTING, CUSTOMIZABLE FACE-ANGLE, AND VARIABLE BULGE AND ROLL FACE

(71) Applicant: Callaway Golf Company, Carlsbad, CA (US)

(72) Inventor: D. Clayton Evans, San Marcos, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/010,118

(22) Filed: Aug. 26, 2013

(65) Prior Publication Data

US 2013/0337935 A1 Dec. 19, 2013

Related U.S. Application Data

(63) Continuation of application No. 13/019,839, filed on Feb. 2, 2011, now Pat. No. 8,550,934, which is a continuation-in-part of application No. 12/939,883, filed on Nov. 4, 2010, now Pat. No. 7,938,741, which is a continuation of application No. 12/776,886, filed on May 10, 2010, now Pat. No. 7,828,673, which is a continuation of application No. 12/266,712, filed on Nov. 7, 2008, now Pat. No. 7,713,143.

(60) Provisional application No. 60/986,864, filed on Nov. 9, 2007.

(51) Int. Cl.
*A63B 53/04* (2006.01)

(52) U.S. Cl.
USPC ..... 473/334; 473/335; 473/338; 473/344; 473/345; 473/349

(58) Field of Classification Search
CPC ..... A63B 53/0466; A63B 53/06; A63B 2053/0412; A63B 2053/0491; A63B 2053/0433
USPC ..... 473/324–350, 287–292
See application file for complete search history.

(56) References Cited

U.S. PATENT DOCUMENTS

| | | | | |
|---|---|---|---|---|
| 7,713,143 | B2 * | 5/2010 | Evans | 473/334 |
| 7,828,673 | B2 * | 11/2010 | Evans | 473/334 |
| 7,938,741 | B2 * | 5/2011 | Evans | 473/334 |
| 8,550,934 | B2 * | 10/2013 | Evans | 473/324 |

* cited by examiner

*Primary Examiner* — Sebastiano Passaniti
(74) *Attorney, Agent, or Firm* — Rebecca Hanovice; Michael A. Catania; Sonia Lari

(57) ABSTRACT

A customizable golf club head is disclosed herein. The customizable golf club head includes a body comprising a crown and a sole and a removable skid plate attached to the sole, wherein the removable skid plate affects the face angle of the golf club head at address. The face angle of the golf club can be further altered by removing the first skid plate and replacing it with a second skid plate having a structure that, when the second skid plate is affixed to the golf club head, causes the golf club head to have a different face angle at address.

20 Claims, 11 Drawing Sheets

GOLF CLUB HEAD WITH ADJUSTABLE WEIGHTING, CUSTOMIZABLE FACE-ANGLE, AND VARIABLE BULGE AND ROLL FACE

CROSS REFERENCES TO RELATED APPLICATIONS

The present application is a continuation of U.S. patent application Ser. No. 13/019,839, filed on Feb. 2, 2011, which is a continuation-in-part of U.S. application Ser. No. 12/939,883, filed on Nov. 4, 2010, and issued as U.S. Pat. No. 7,938,741 on May 10, 2011, which is a continuation of U.S. application Ser. No. 12/776,886, filed on May 10, 2010, and issued as U.S. Pat. No. 7,828,673 on Nov. 9, 2010, which is a continuation of U.S. patent application Ser. No. 12/266,712, filed on Nov. 7, 2008, and issued as U.S. Pat. No. 7,713,143 on May 11, 2010, which claims priority to U.S. Provisional Patent Application No. 60/986,864, filed on Nov. 9, 2007.

STATEMENT REGARDING FEDERALLY SPONSORED RESEARCH OR DEVELOPMENT

Not Applicable

BACKGROUND OF THE INVENTION

1. Field of the Invention

The present invention relates to a golf club heads. More specifically, the present invention relates to a golf club head with adjustable weighting and customizable face properties.

2. Description of the Related Art

Currently, customization of drivers to help golfers hit better (longer, straighter, pleasing trajectory) shots is relatively new to the marketplace. Such customization currently includes: different shaft flexes and lengths, different lofts, and different head weighting scenarios. Currently most heads come with the head weighting pre-built into the head such that it cannot be changed. There are some companies that allow screw-in weights that can be changed by the golfer or by the fitting personnel to change a drivers weight distribution (Center of Gravity: CG) to promote desired ball flight tendencies. There currently exists no method to alter the driver's face angle at address, which visually gives the golfer an indication of the clubs orientation or hit tendency. In addition, current driver models have higher Moments of Inertia (MOI) that correspondingly need a flatter face to hit straighter shots. This flatter face is not as cosmetically appealing as the rounder faces of previous driver designs with lower MOI values.

BRIEF SUMMARY OF THE INVENTION

The primary purpose this invention is to effectively incorporate the following three design features into a driver design. First, visible and removable weights to adjust the center of gravity of the club head using a new and novel method of affixing these weights to the club head. Second, different height skid plates on the sole to alter the club's face angle at address (as it sits naturally on the ground). Third, a unique face design using bulge and roll values at the center region of the face for hitting straighter and more consistent shots, while having a different bulge and roll at the edge of the face to promote a more pleasing appearance to the golfer. In providing the above design features into a club head design, the golfer should have an improved driver suited to his/her needs, abilities, and preferences to hit better shots.

One aspect of the present invention is a wood-type golf club head comprising a face component, a body comprising a crown and a sole, and a removable skid plate attached to the sole, wherein the removable skid plate affects the face angle of the golf club head at address. The skid plate may be removably affixed to the sole using at least one or more materials selected from the group consisting of screws, clips, rivets, double-backed adhesive tape, and heat softened glue, and the skid plate may be composed of one or more materials selected from the group consisting of aluminum, steel, magnesium, titanium, titanium alloy, polymer, and graphite composite. The face component may be composed of a metal material selected from the group consisting of titanium, stainless steel, and amorphous metal, and more particularly a titanium material, while the body may be composed of a composite material.

Another aspect of the present invention is a wood-type golf club head comprising a face component, a body comprising a crown and a sole, a receiving pocket having a receiving structure, and a removable skid plate having a plurality of compressible tabs, wherein the receiving pocket is located in the sole, and wherein the removable skid plate is positioned within the receiving pocket such that the compressible tabs lock the weight member within the receiving structure of the receiving pocket. The receiving structure may further comprise indentations or protrusions.

Yet another aspect of the present invention is a wood-type golf club head comprising a face component, a body comprising a crown and a sole, at least one receiving pocket having a receiving structure, and at least one removable weight member having a plurality of compressible tabs, wherein the at least one receiving pocket is located in one or more of the face component, the crown, and the sole, and wherein the removable weight member is positioned within the receiving pocket such that the compressible tabs lock the weight member within the receiving structure of the receiving pocket. The receiving structure may comprise indentations or protrusions, and the golf club head may further comprise a plurality of receiving pockets. The at least one receiving pocket may be located in the sole or, alternatively, in the crown.

Another aspect of the present invention is a method of adjusting a face angle of a wood-type golf club head comprising providing a club head body comprising a face component, a crown, and a sole, providing a plurality of removable skid plates having structures that differ from one another, selecting a skid plate having a structure that will cause the golf club head to have a desired face angle, and removably affixing the selected skid plate to the sole, wherein each individual skid plate structure, when affixed to the golf club head, causes the golf club head to have a different face angle at address. A receiving pocket may further be located in the sole, wherein the receiving pocket has a receiving structure, wherein the plurality of removable skid plates each have a plurality of compressible tabs, and wherein the selected skid plate is positioned within the receiving pocket such that the compressible tabs lock the selected skid plate within the receiving structure of the receiving pocket. Each of the plurality of removable skid plates may be composed of one or more materials selected from the group consisting of aluminum, steel, magnesium, titanium, titanium alloy, polymer, and graphite composite. The plurality of removable skid plates may comprise a first skid plate that, when affixed to the golf club head, causes the golf club head to have a 1° open face angle at address and a second skid plate that, when affixed to the golf club head, causes the golf club head to have a 2° open face angle at address.

Yet another aspect of the present invention is a wood-type golf club head comprising a body comprising a crown and a sole and a face component having a striking area and a return portion, wherein the striking area comprises an outer face, an inner face, and an intersection boundary between the outer and inner faces, wherein the outer face has first bulge and roll values, wherein the inner face has second bulge and roll values, wherein the first bulge and roll values are smaller than the second bulge and roil values, and wherein the intersection boundary comprises a tangential fillet blend that smoothly connects and transitions between the outer face and the inner face. The body may be composed of a composite material and the face component may be composed of a metal material, such as titanium alloy.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
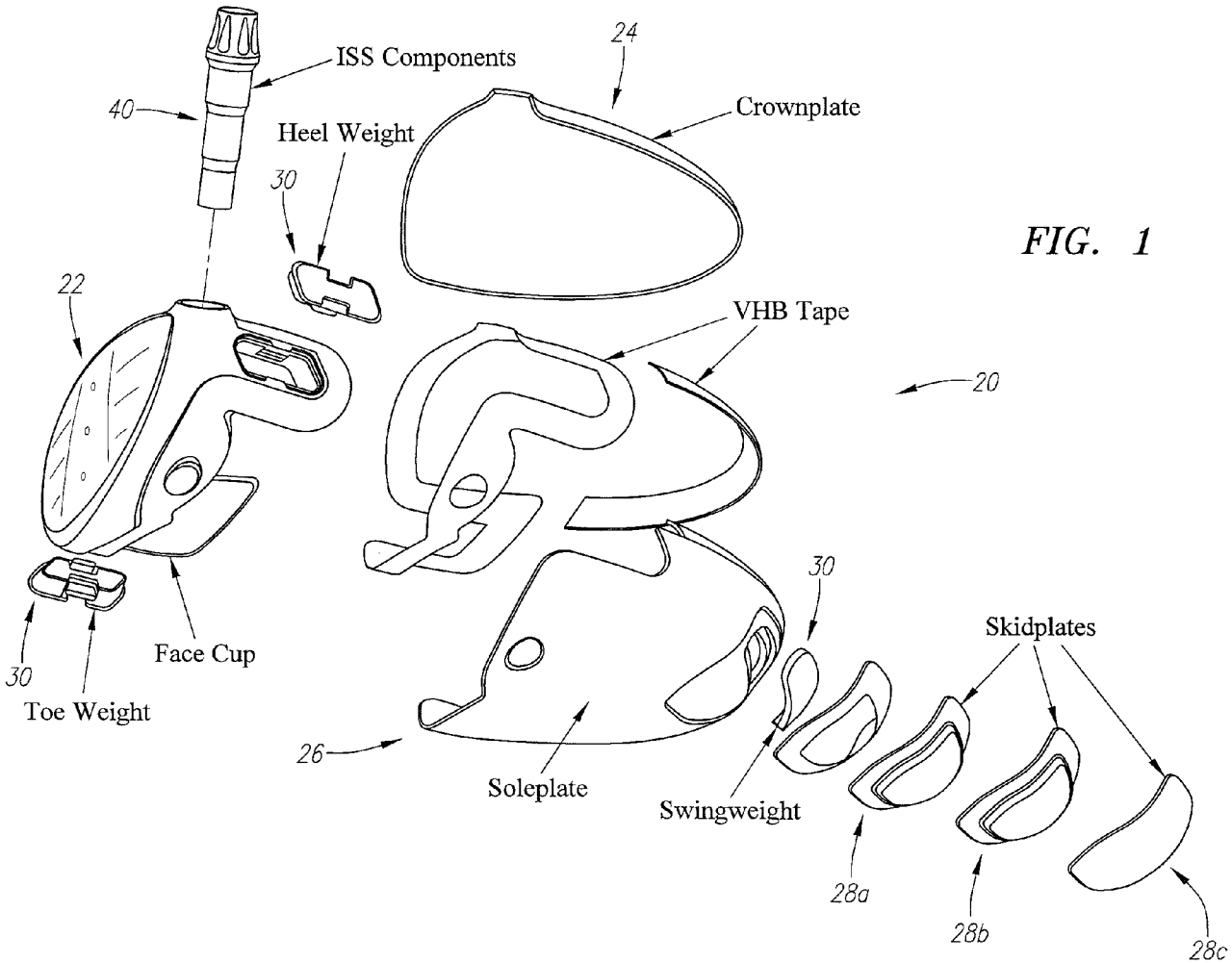
FIG. 1 is an exploded view of a preferred embodiment of the present invention.
Figure 1A:
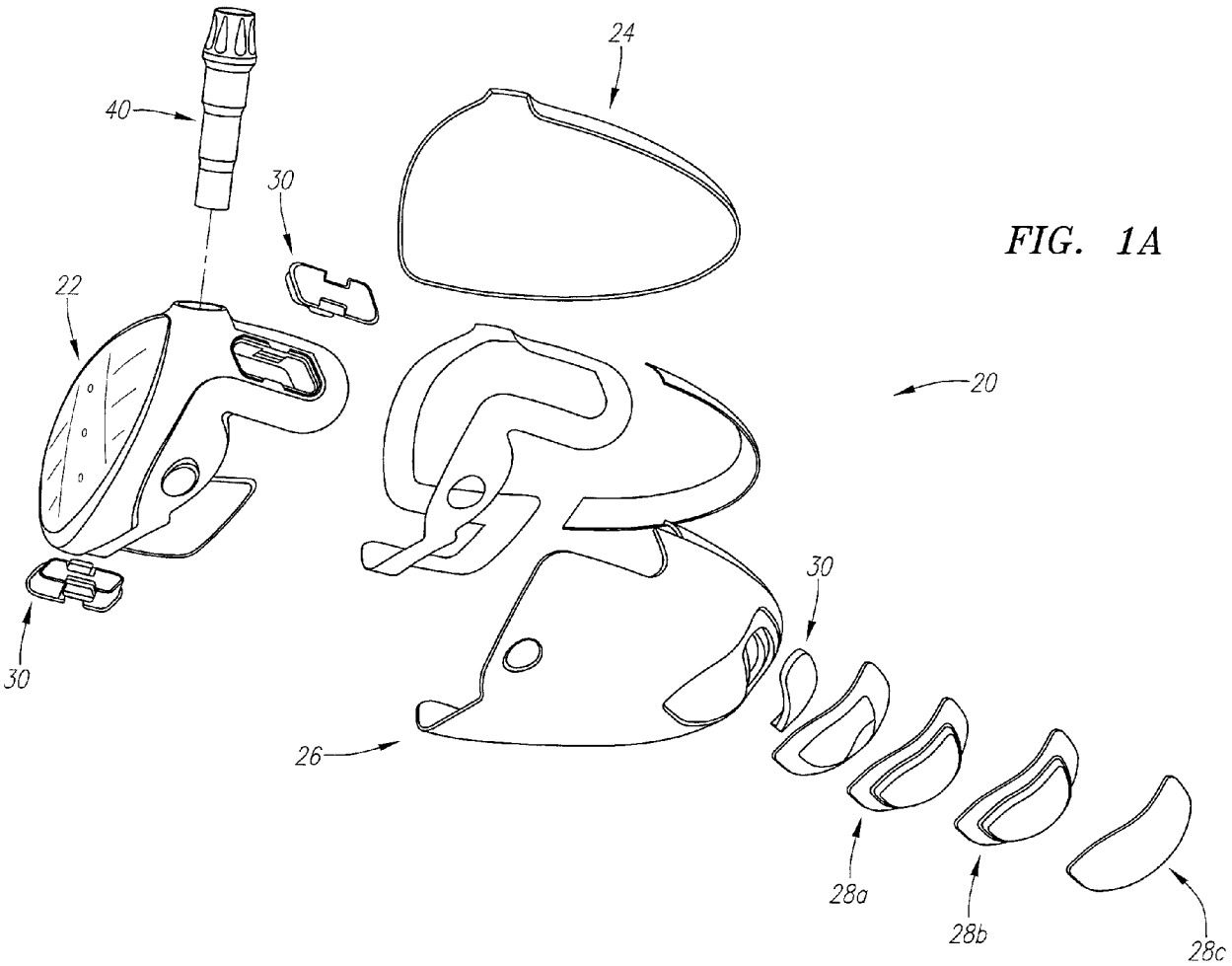
FIG. 1A is an exploded view of a preferred embodiment of the present invention.
Figure 2:
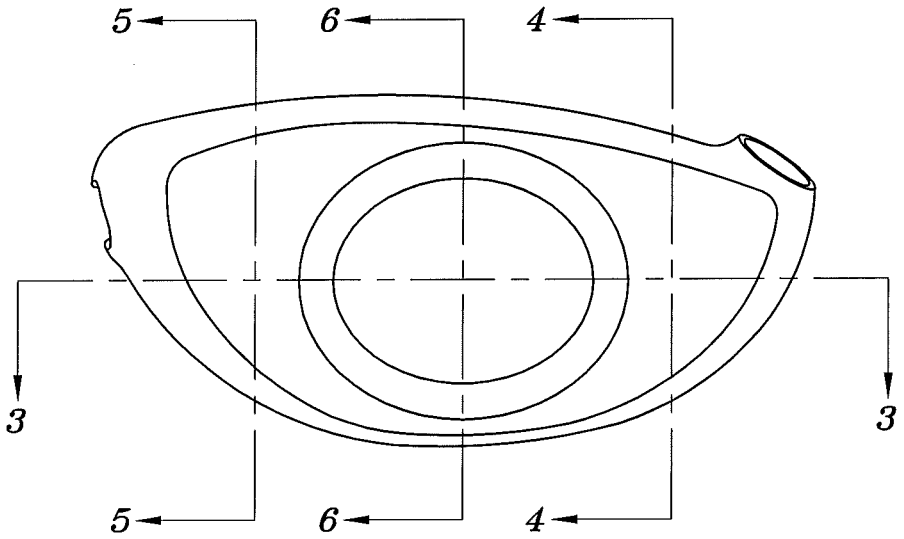
FIG. 2 is a view of the face.
Figure 3:
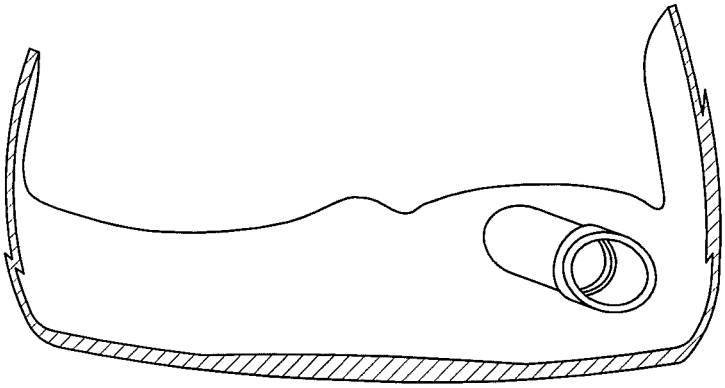
FIG. 3 is a cross-sectional view along line B-B of FIG. 2.
Figure 4:
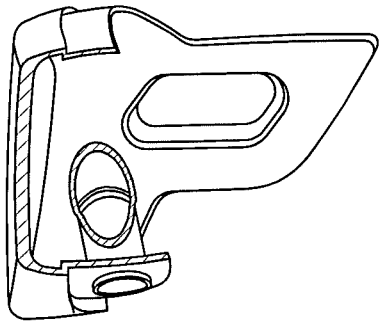
FIG. 4 is a cross-sectional view along line D-D of FIG. 2.
Figure 5:
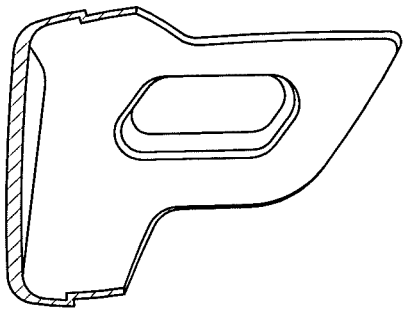
FIG. 5 is a cross-sectional view along line C-C of FIG. 2.
Figure 6:
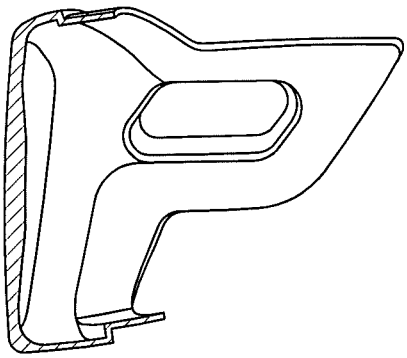
FIG. 6 is a cross-sectional view along line A-A of FIG. 2.
Figure 7:
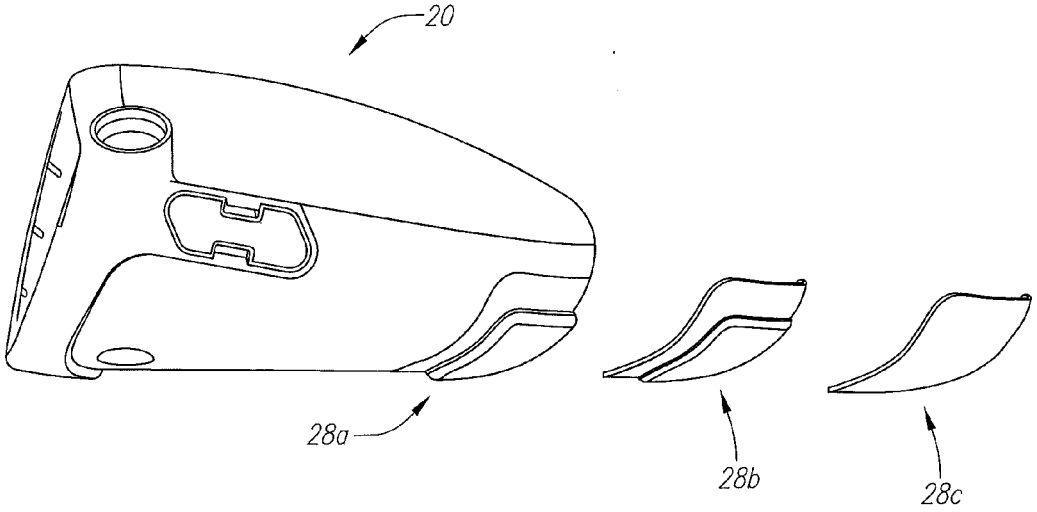
FIG. 7 is a heel side of a golf club head of with alternative skid-plates for adjusting the face angle.
Figure 8:
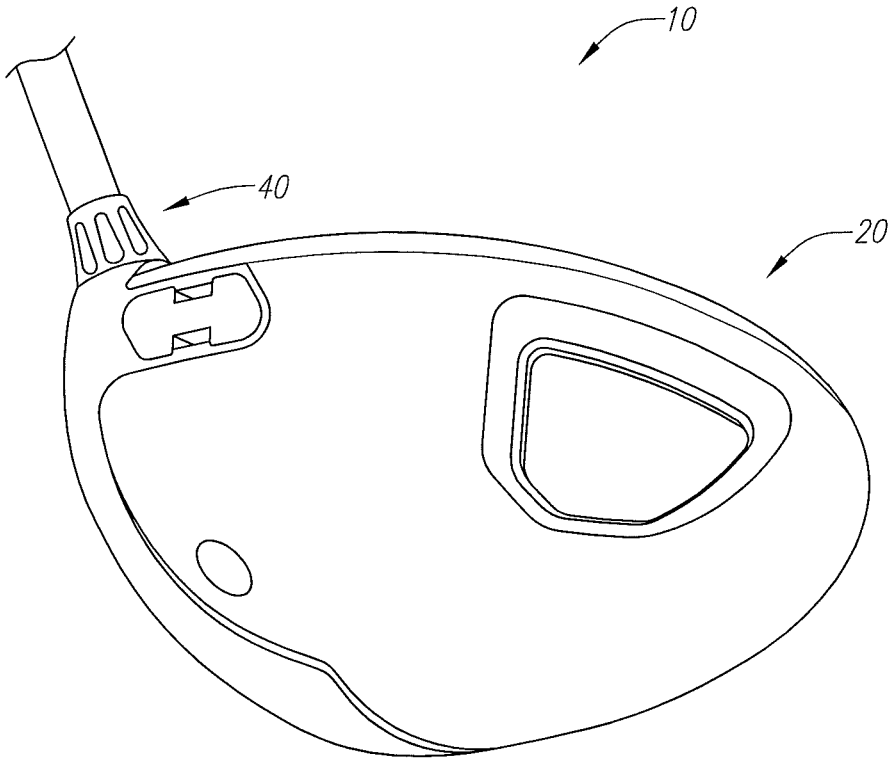
FIG. 8 is a bottom perspective view of a golf club of the present invention.
Figure 9:
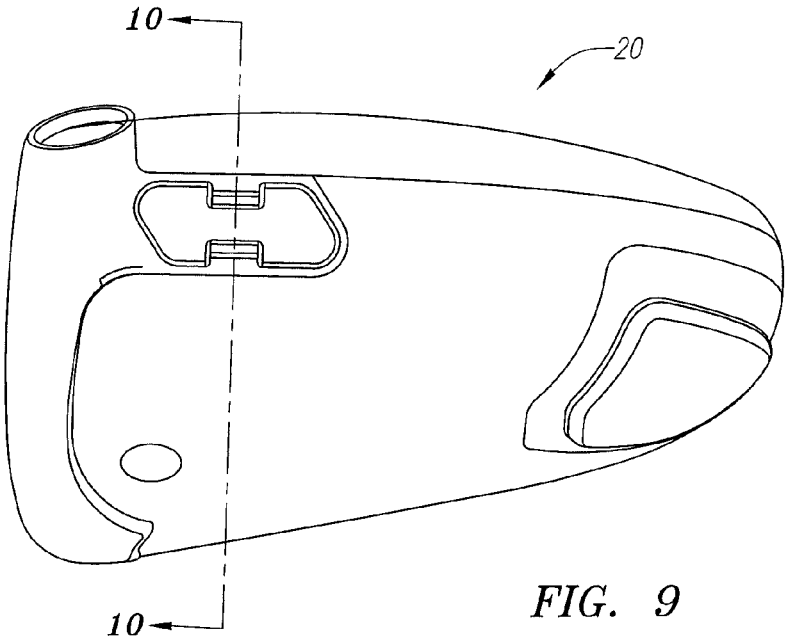
FIG. 9 is a heel side of a golf club head.
Figure 10:
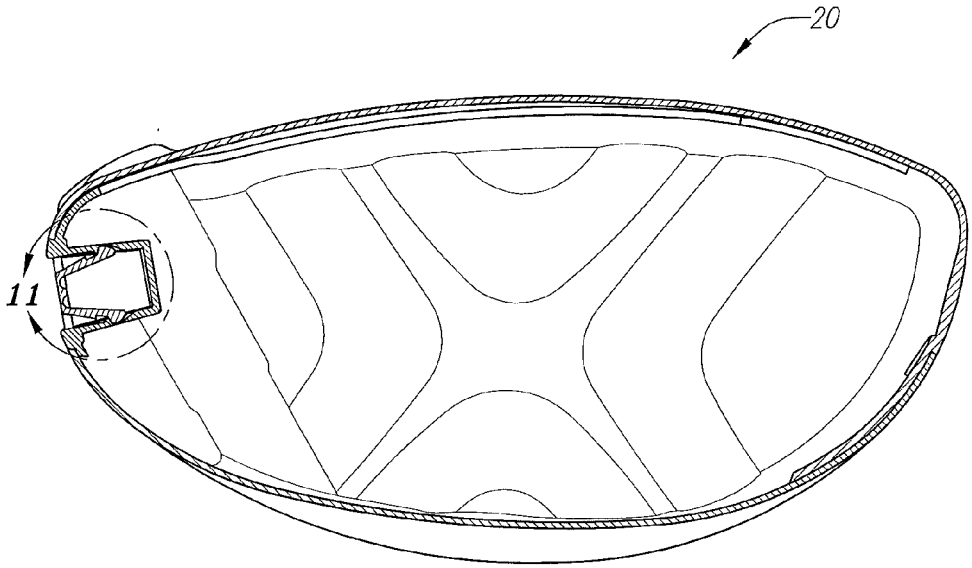
FIG. 10 is a cross-sectional view along line A-A of FIG. 9.
Figure 11:
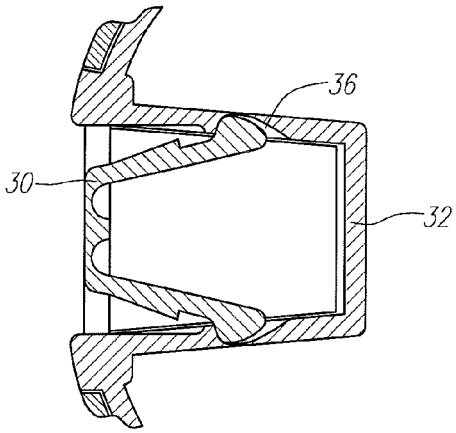
FIG. 11 is an enlarged view of circle B of FIG. 10.
Figure 12:
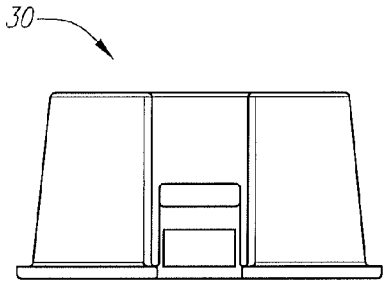
FIG. 12 is an isolated side view of a weight member.
Figure 13:
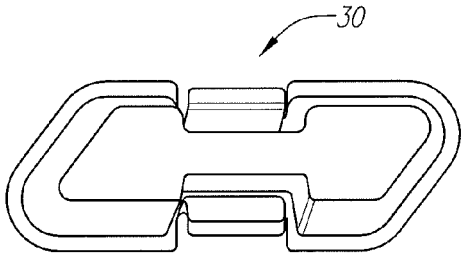
FIG. 13 is an isolated top view of a weight member.
Figure 14:
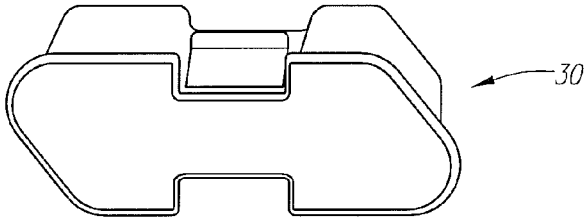
FIG. 14 is an isolated bottom view of a weight member.
Figure 15:
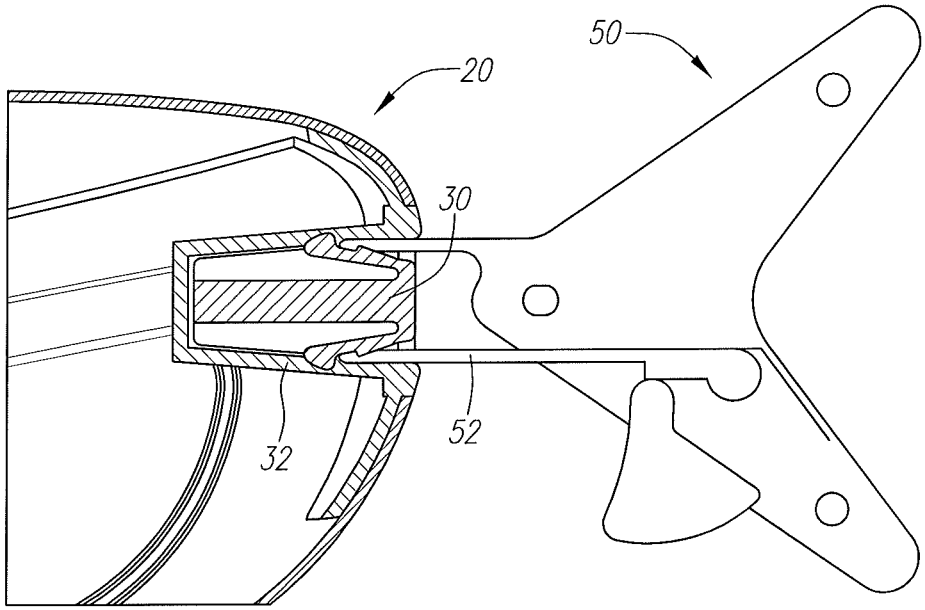
FIG. 15 is a cut-away view of a tool with jaws extracting a weight member form a pocket of a golf club head of the present invention.
Figure 16:
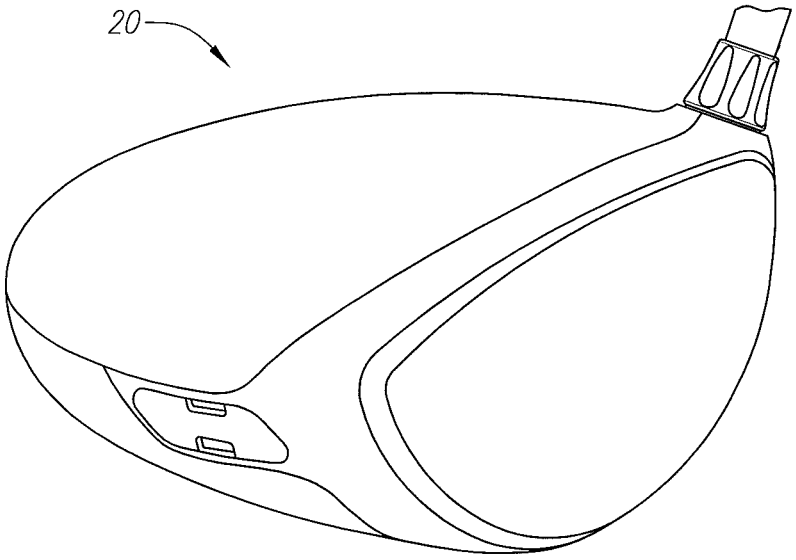
FIG. 16 is a top perspective view of a golf club head of the present invention.
Figure 17:
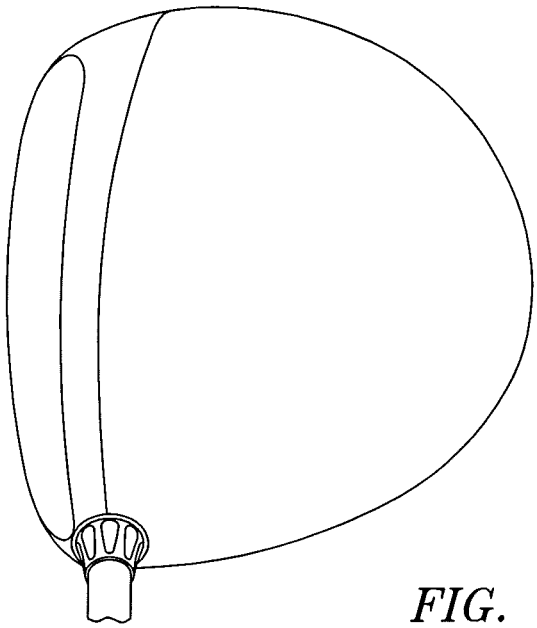
FIG. 17 is a top plan view of a golf club head of the present invention.
Figure 18:
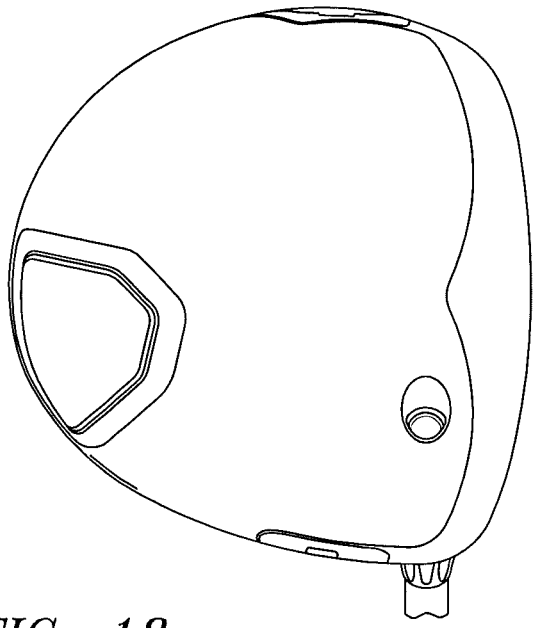
FIG. 18 is a bottom plan view of a golf club head of the present invention.
Figure 19:
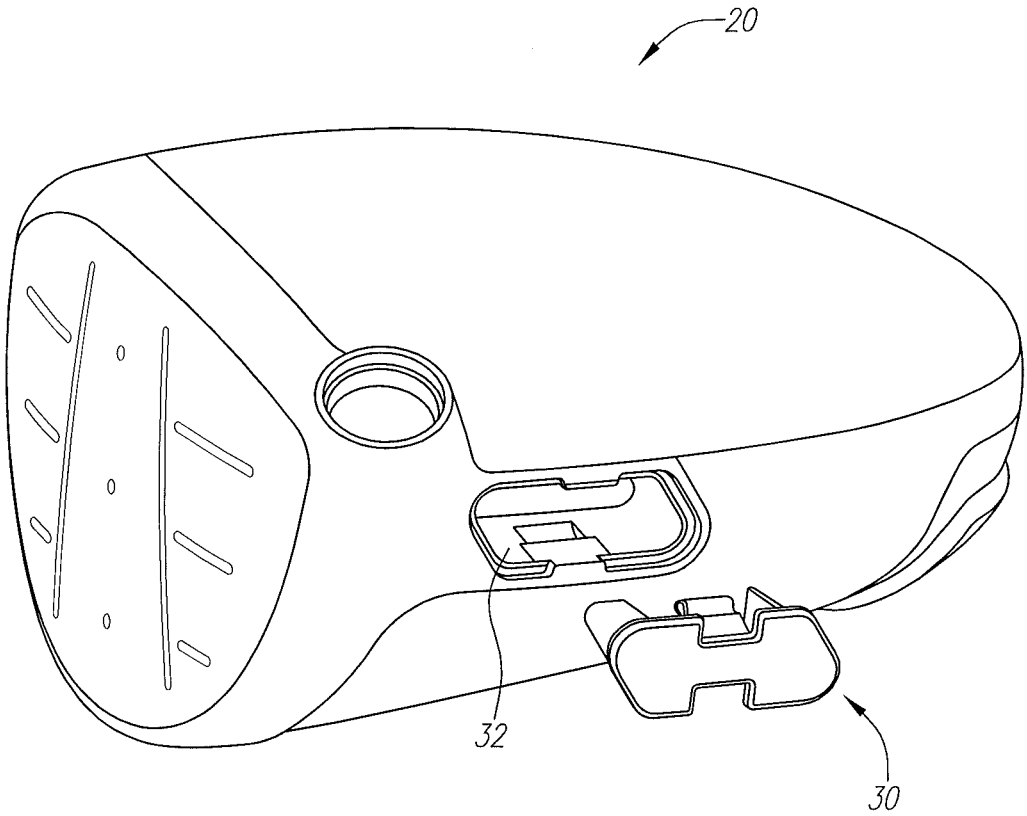
FIG. 19 is a top perspective view of a golf club head of the present invention with a weight member removed from a pocket.

The golf club head 20 of the present invention preferably includes a cast titanium face component 22, a composite crown-plate 24, a composite sole-plate 26, an aluminum skid-plate 28, two stainless steel removable weight members 30*a* and 30*b*, one stainless steel swingweight member 30*c*, and interchangeable shaft system 40 capability. There is also a tool 50 designed to extract the weight members 30 from the golf club head 20. The tool 50 is not generally needed to affix the weight members 30 to the golf club head 20, A preferred embodiment of the golf club head 20 has a volume of 460 cubic centimeters with the Characteristic Time (CT) of the face close to, but not exceeding 257 microsecond ("μS") limit set by the USGA.

The mechanical properties of the golf club head 20 showing the CG location, Inertia values and other golf club head information are shown for three weighting scenarios: fade, neutral, and draw.

There are four basic features of the golf club head 20 of the present invention that make it unique over the prior art. These features are explained in further detail below.

Most notable of all the features on the golf club head 20 of the present invention are the visible and removable weights. The weight members 30 are preferably composed of a stainless steel material. Alternatively, the weight members 30 are formed by casting, powder metallurgy, metal-injection-molded (MIM), or any other fabrication process that exists to make these metals. Alternatively, the weight members 30 are made from a polymer based material combined with metal particles to increase the density/weight to be equivalent to stainless steel.

The weight member 30 is preferably inserted into a receiving pocket 32 that has indentations 36 created in the interior of the pocket 32 which allows the tabs on the weight member 30 to "snap" into and hold the weight member 30 securely. The weight member tabs 34 are compressed by the inner surface of the pocket 32 until they have reached the receiving indentations 36 and then they expand and subsequently lock the weight member 30 inside the weight pocket 32.

For removal of the weight members 30, a specially designed tool 50 is inserted between the weight pocket interior wall and the weight member's tabs 34. Pushing the tool 50 further into the pocket 32 forces the weight member's tabs 34 away from the interior wall of the weight pocket 32 until they have been pushed out of the receiving indentations 36 of the pocket wall. The tool 50 is forced further into the pocket 32 until the weight member tabs 34 are captured by the tool 50, at which point, the tool 50 is pulled from the weight pocket 32 and the captured weight member 30 is removed with the tool 50. The tool 50 has a release mechanism that opens the jaws 52 of the tool 50 and the weight member 30 is free to be removed from the tool 50.

The golf club head 20 of the present invention preferably has multiple weight members 30 with various masses. In a preferred embodiment, the weight members 30 include a 15 g weight member, a 10 g weight member, and a 5 g weight member. The draw bias CG location of the golf club head 20 of the present invention is enabled by placing the 15 g weight member 30 in the heel pocket and the 5 gram weight member 30 into the toe pocket 32. The neutral bias CG location golf club head 20 of the present invention is enabled by placing the 10 g weight members 30 into both the toe and heel weight pockets 32. The fade bias CG location golf club head 20 of the present invention is enabled by placing the 5 g weight member 30 in the heel pocket and the 15 gram weight member 30 into the toe pocket 32.

The standard skid-plate 28 of the golf club head 20 is designed to allow for the golf club to sit at address at the designed face angle. Two additional skid-plates 28 allow for a 1° open face angle and a 2° open face angle. In the preferred embodiment, one of the three skid-plates is semi-permanently affixed to the golf club head 20 after the golfer has temporarily affixed each of them on the golf club head 20 of his or her choice and made a selection of which skid-plate 28 is preferred. The skid plate can be semi-permanently affixed to the club head by means of a fastener or fasteners such as screws, clips, rivets, double-backed adhesive tape, or heat softening glue. Each of these options permits a user to remove the skid-plate without causing structural damage to the golf club head 20. In an alternative embodiment, the selected skid-plate is permanently affixed to the golf club head 20. The skid-plates 28 have approximately the same weight so the swingweight and performance of the golf club will remain unchanged regardless of which skid-plate 28 is selected to be affixed to the golf club head 20, Skid plates 28 can be made from aluminum, steel, magnesium, titanium, titanium alloys, polymer, graphite composite, or combinations thereof.

The variable bulge and roll face 23 is a combination of two faces. The outer face is made with cosmetically pleasing smaller bulge and roll values and is trimmed in the center region by a performance-based inner face that has larger bulge and roll values. The transition at the intersection boundary between the outer and inner faces is made smooth and undetectable by a tangential fillet blend which connects them with a known radius value. The entire face 23 of the golf club head 20 is a combination of a bulge and a roll impact face that works best for the majority of hit locations while outside of this impact region, a face that blends more acceptable with the sole, side, and crown surfaces is used.

The crown-plate 24 and sole-plate 26 fit onto the exterior surfaces of the face-component 22. The golf club head 20 has a separate crown-plate 24 and sole-plate 26 bonded on the exterior surfaces of the flange 25 of the face component 22 and to each other along the rearward part of the golf club head 20. The crown-plate 24 and sole-plate 26 are preferably bonded with VHB adhesive tape. Alternatively, the crown-plate 24 and sole-plate 26 are preferably bonded with a "wet" epoxy adhesive. Yet alternatively, crown-plate 24 and sole-plate 26 are preferably bonded with a combination of both VHB adhesive tape and wet epoxy. The bonding method enables the aesthetic design of the golf club head 20 to be more versatile by not being restricted to any negative draw constraints in the face-component. The use of separate crown-plates 24 and soleplates 26 also lowers the costs.

A golf club 10 of the present invention preferably utilizes an interchangeable shaft system 40 such as disclosed in Evans, U.S. Pat. No. 7,115,046, Cackett, et al., U.S. Pat. No. 7,083,529, and Hocknell, et al., U.S. Patent Publication Number 2007/0054749, all of which are hereby incorporated by reference in their entireties.

In general, the moment of inertia, Izz, about the Z axis for the golf club head 20 of the present invention will range from 3500 g-cm$^2$ to 6000 g-cm$^2$, preferably from 4000 g-cm$^2$ to 5000 g-cm$^2$, and most preferably from 4200 g-cm$^2$ to 4750 g-cm$^2$. The moment of inertia, Iyy, about the Y axis for the golf club head 20 of the present invention will range from 2000 g-cm$^2$ to 4000 g-cm$^2$, preferably from 2500 g-cm$^2$ to 3500 g-cm$^2$, and most preferably from 2900 g-cm$^2$ to 3300 g-cm$^2$. The moment of inertia, Ixx, about the X axis for the golf club head 20 of the present invention will range from 2000 g-cm$^2$ to 4000 g-cm$^2$, preferably from 2500 g-cm$^2$ to 3750 g-cm$^2$, and most preferably from 3000 g-cm$^2$ to 3500 g-cm$^2$.

In general, the golf club head 20 has products of inertia such as disclosed in U.S. Pat. No. 6,425,832, which is hereby incorporated by reference in its entirety. Preferably, each of the products of inertia, Ixy, Ixz and Iyz, of the golf club head 20 have an absolute value less than 100 grams-centimeter squared. Alternatively, at least two of the products of inertia, Ixy, Ixz or Iyz, of the golf club head 20 have an absolute value less than 100 grams-centimeter squared.

The center of gravity and the moment of inertia of a golf club head 20 are preferably measured using a test frame ($X^T$, $Y^T$, $Z^T$), and then transformed to a head frame ($X^H$, $Y^H$, $Z^H$). The center of gravity of a golf club head may be obtained using a center of gravity table having two weight scales thereon, as disclosed in U.S. Pat. No. 6,607,452, entitled High Moment Of Inertia Composite Golf Club, and hereby incorporated by reference in its entirety. If a shaft is present, it is removed and replaced with a hosel cube that has a multitude of faces normal to the axes of the golf club head, Given the weight of the golf club head, the scales allow one to determine the weight distribution of the golf club head when the golf club head is placed on both scales simultaneously and weighed along a particular direction, the X, Y or Z direction. Those skilled in the pertinent art will recognize other methods to determine the center of gravity and moments of inertia of a golf club head.

In a preferred embodiment, the golf club head 20 has a high coefficient of restitution thereby enabling for greater distance of a golf ball hit with the golf club 10. The coefficient of restitution (also referred to herein as "COR") is determined by the following equation:

$$e = \frac{v_2 - v_1}{U_1 - U_2}$$

wherein $U_1$ is the club head velocity prior to impact; $U_2$ is the golf ball velocity prior to impact which is zero; $v_1$ is the club head velocity just after separation of the golf ball from the face of the club head; $v_2$ is the golf ball velocity just after separation of the golf bail from the face of the club head; and e is the coefficient of restitution between the golf ball and the club face.

The values of e are limited between zero and 1.0 for systems with no energy addition. The coefficient of restitution, e, for a material such as a soft clay or putty would be near zero, while for a perfectly elastic material, where no energy is lost as a result of deformation, the value of e would be 1.0. The present invention provides a club head having a coefficient of restitution ranging from 0.81 to 0.94, as measured under conventional test conditions.

The coefficient of restitution of the club head 20 ranges from approximately 0.81 to 0.94, preferably ranges from 0.825 to 0.883 and is most preferably 0.845.

In a preferred embodiment, the face 23 has a varying thickness such as described in U.S. Pat. No. 6,398,666, for a Golf Club Striking Plate With Variable Thickness, which pertinent parts are hereby incorporated by reference. Other alternative embodiments of the thickness of the face 23 are disclosed in U.S. Pat. No. 6,471,603, for a Contoured Golf Club Face and U.S. Pat. No. 6,368,234, for a Golf Club Striking Plate Having Elliptical Regions Of Thickness, which are both owned by Callaway Golf Company and which pertinent parts are hereby incorporated by reference. Alternatively, the face 23 has a uniform thickness.

The golf club head 20, when designed as a driver, preferably has a volume from 200 cubic centimeters to 600 cubic centimeters, more preferably from 300 cubic centimeters to 500 cubic centimeters, and most preferably from 420 cubic centimeters to 470 cubic centimeters, with a most preferred volume of 460 cubic centimeters. The volume of the golf club head 20 will also vary between fairway woods (preferably ranging from 3-woods to eleven woods) with smaller volumes than drivers.

The golf club head 20, when designed as a driver, preferably has a mass no more than 215 grams, and most preferably a mass of 180 to 215 grams. When the golf club head 20 is designed as a fairway wood, the golf club head preferably has a mass of 135 grams to 200 grams, and preferably from 140 grams to 165 grams.

EXAMPLES

Fade Embodiment

Impact Loft: 12.000
Design Loft: 12.000
Lie: 56.000
Bulge: 11.500
Roll: 0.000
Face Angle: −1.000
Total Mass: 204.868
Head Frame Mass Properties:
CGX, CGY, CGZ: 0.5745, 0.8272, 1.1317
IXX, IYY, IZZ: 3357.66, 2621.47, 4975.30
IXY, LXZ, IYZ: 75.72, −281.03, 147.11
Hosel Frame Mass Properties:
CGX, CGY, CGZ: 0.5745, 1.3186, −1.7829
IXX, IYY, IZZ: 3357.66, 3221.10, 4375.66
IXY, IXZ, IYZ: 94.37, 275.33, 1036.11
Impact Frame Mass Properties:
CGX, CGY, CGZ: 1.2633, −0.0287, 0.1883
IXX, IYY, IZZ: 3313.28, 2621.47, 5019.68
IXY, IXZ, IYZ: −43.48, −72.25, −159.64
Impact Center X, Y, Z: −0.7003, 0.8559, 1.2101
Bulge Roll Apex X, Y, Z: −0.7003, 0.8559, 1.2101

Neutral Embodiment

Impact Loft: 12.000
Design Loft: 12.000
Lie: 56.000
Bulge: 11.500
Roll: 0.000
Face Angle: −1.000
Total Mass: 205.282
Head Frame Mass Properties:
CGX, CGY, CGZ: 0.5742, 0.7229, 1.1245
IXX, IYY, IZZ: 3337.71, 2618.19, 4958.16
IXY, IXZ, IYZ: 43.05, −283.78, 123.97
Hosel Frame Mass Properties:
CGX, CGY, CGZ: 0.5742, 1.2282, −1.7305
IXX, IYY, IZZ: 3337.71, 3234.95, 4341.41
IXY, IXZ, IYZ: 123.00, 259.34, 1038.35
Impact Frame Mass Properties:
CGX, CGY, CGZ: 1.2645, −0.1330, 0.1813
IXX, IYY, IZZ: 3292.33, 2618.19, 5003.54
IXY, IXZ, IYZ: −16.34, −70.30, −130.21
Impact Center X, Y, Z: −0.7003, 0.8559, 1.2101
Bulge Roll Apex X, Y, Z: −0.7003, 0.8559, 1.2101

Draw Embodiment

Impact Loft: 12.000
Design Loft: 12.000
Lie: 56.000
Bulge: 11.500
Roll: 0.000
Face Angle: −1.000
Total Mass: 204.874
Head Frame Mass Properties:
CGX, CGY, CGZ: 0.5727, 0.6176, 1.1189
IXX, IYY, IZZ: 3210.34, 2614.51, 4832.02
IXY, IXZ, IYZ: 11.41, −285.92, 95.59
Hosel Frame Mass Properties:
CGX, CGY, CGZ: 0.5727, 1.1377, −1.6762
IXX, IYY, IZZ: 3210.34, 3219.28, 4227.24
IXY, IXZ, IYZ: 150.42, 243.42, 992.21
Impact Frame Mass Properties:
CGX, CGY, CGZ: 1.2641, −0.2383, 0.1755
IXX, IYY, IZZ: 3164.14, 2614.51, 4878.21
IXY, IXZ, IYZ: 8.71, −68.59, −95.88
Impact Center X, Y, Z: −0.7003, 0.8559, 1.2101
Bulge Roll Apex X, Y, Z: −0.7003, 0.8559, 1.2101

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention:

1. A driver-type golf club head comprising:
a face component;
a body comprising a crown, a sole, and a plurality of receiving pockets, each having a receiving structure;
a plurality of removable weight members, each having a plurality of compressible tabs; and
a plurality of removable skid plates, each capable of attachment to the sole,
wherein each of the removable skid plates affects the face angle of the golf club head at address, and
wherein each of the plurality of weight members is positioned within one of the plurality of receiving pockets such that the compressible tabs lock the weight member within the receiving structure of the receiving pocket.

2. The driver-type golf club head of claim 1, wherein each of the plurality of skid plates is removably affixed to the sole using at least one or more materials selected from the group consisting of screws, clips, rivets, double-backed adhesive tape, and heat softened glue.

3. The driver-type golf club head of claim 1, wherein each of the plurality of skid plates is composed of one or more materials selected from the group consisting of aluminum, steel, magnesium, titanium, titanium alloy, polymer, and graphite composite.

4. The driver-type golf club head of claim 1, wherein the plurality of skid plates comprises a first skid plate that creates a 1° open face angle at address and a second skid plate that creates a 2° open face angle at address.

5. The driver-type golf club head of claim 1 wherein the face component is composed of a metal material selected from the group consisting of titanium, stainless steel, and amorphous metal.

6. The driver-type golf club head of claim 4 wherein the face component is composed of a titanium material.

7. The driver-type golf club head of claim 1, wherein the body is composed of a composite material.

8. The driver-type golf club head of claim 1, wherein the golf club head has an Izz of 3500 g-cm$^2$ to 6000 g-cm$^2$, an Iyy of 2000 g-cm$^2$ to 4000 g-cm$^2$, and an Ixx of 2000 g-cm$^2$ to 4000 g-cm$^2$.

9. The driver-type golf club head of claim 1, wherein the golf club head has a volume of 300 cubic centimeters to 500 cubic centimeters.

10. The driver-type golf club head of claim 1, wherein the face component comprises a striking face having a variable thickness.

11. The driver-type golf club head of claim 1, further comprising an interchangeable shaft system.

12. A driver-type golf club head comprising:

a metal face component comprising variable bulge and variable roll values;

a body comprising a crown, a sole, and a plurality of receiving pockets, each having a receiving structure;

a plurality of removable weight members; and a plurality of removable skid plates, each capable of attachment to the sole, wherein each of the removable skid plates affects the face angle of the golf club head at address.

13. The driver-type golf club head of claim 12, wherein each of the plurality of removable weight members has a mass of 1 gram to 50 grams.

14. The driver-type golf club head of claim 12, wherein each of the plurality of skid plates is removably affixed to the sole using at least one or more materials selected from the group consisting of screws, clips, rivets, double-backed adhesive tape, and heat softened glue.

15. The driver-type golf club head of claim 12, wherein each of the plurality of skid plates is composed of one or more materials selected from the group consisting of aluminum, steel, magnesium, titanium, titanium alloy, polymer, and graphite composite.

16. The driver-type golf club head of claim 12, wherein the plurality of skid plates comprises a first skid plate that creates a 1° open face angle at address and a second skid plate that creates a 2° open face angle at address.

17. The driver-type golf club head of claim 12, wherein each of the removable weight members comprises a plurality of compressible tabs, and wherein each of the removable weight members is positioned within one of the plurality of receiving pockets such that the compressible tabs lock the weight member within the receiving structure of the receiving pocket.

18. The driver-type golf club head of claim 12, wherein at least one of the removable weight members is composed of a stainless steel material.

19. The driver-type golf club head of claim 12, wherein the golf club head has a coefficient of restitution of no less than 0.81 and no more than 0.883.

20. The driver-type golf club head of claim 12, wherein the golf club head has a mass of 180 to 215 grams.

* * * * *